United States Patent [19]

Jurgens

[11] Patent Number: 5,070,798

[45] Date of Patent: Dec. 10, 1991

[54] PELLET BURNER APPLIANCES AND BURNERS THEREFOR

[75] Inventor: Heinrich J. W. Jurgens, Eatonville, Wash.

[73] Assignee: Heatilator, Inc., Mt. Pleasant, Iowa

[21] Appl. No.: 575,956

[22] Filed: Aug. 31, 1990

[51] Int. Cl.[5] ..... F23K 3/14; F23K 3/16

[52] U.S. Cl. ..... 110/110; 110/102; 110/233

[58] Field of Search ..... 110/102, 110, 108, 233

[56] References Cited

U.S. PATENT DOCUMENTS

| | | | |
|---|---|---|---|
| 1,139,857 | 5/1915 | Garey . | |
| 2,014,171 | 9/1935 | Fischel . | |
| 2,067,583 | 1/1937 | Stark . | |
| 2,143,834 | 1/1939 | Mosshart . | |
| 2,315,070 | 3/1943 | McNaughton . | |
| 2,584,235 | 2/1952 | Skelly . | |
| 2,689,560 | 9/1954 | Johnson . | |
| 4,323,017 | 4/1982 | Harris . | |
| 4,351,315 | 9/1982 | Babbage . | |
| 4,385,566 | 5/1983 | Harris . | |
| 4,515,088 | 5/1985 | Orjala | 110/110 |
| 4,565,184 | 1/1986 | Collins . | |
| 4,574,712 | 3/1986 | David . | |
| 4,593,629 | 6/1986 | Pedersen et al. | 110/110 X |
| 4,619,209 | 10/1986 | Traeger et al. | 110/110 |
| 4,856,438 | 8/1989 | Peugh . | |
| 4,941,414 | 7/1990 | Carlson | 110/108 |

*Primary Examiner*—Edward G. Favors

*Attorney, Agent, or Firm*—Neuman, Williams, Anderson & Olson

[57] ABSTRACT

A pellet burning appliance with an improved burner is disclosed. This improved burner includes an open ended retort in communication with a feed auger at the inlet end opposite the open end. The feed auger delivers solid fuel pellets through the inlet end which results in underfeeding action and cross-flow of the combustion bed. An air hole arrangement introduces primary and secondary air for highly efficient burning. The floor of the retort is flat, and colinear with the bottom of the auger tube. The burner is inclined within the appliance at approximately 22.5° from the horizontal. This design promotes efficient burning as the constantly fed fuel spreads evenly whereby it combusts over substantially the entire length of the retort. The feeding action continually pushes clinkers and other combustion inhibiting particulates, in an unobstructed manner, off the retort's terminal end.

31 Claims, 3 Drawing Sheets

PELLET BURNER APPLIANCES AND BURNERS THEREFOR

BACKGROUND OF THE INVENTION

This invention relates generally to pellet burning systems and more particularly to burners suitable for use within a pellet burning heating appliance.

Pellets or fuel pellets, as those terms are used herein, are solid particulate fuels sufficiently uniform in size to permit convenient forcible feeding in bulk form, such as through a feed auger. Examples include pellets of compressed materials such as wood waste, nut shells, other celluosic products, small coal particles or the like which may be preformed into pellets, and naturally solid particles such as screened coal chips.

Typical pellet burning appliances are characterized by the burner system employed. Such systems often are described as overfed or underfed.

The overfed system is identified as such because fuel is dropped into the burner from above, usually six to eight inches. The burner, which may be shaped like a cup, receives the fuel wherein combustion takes place. Typical cup shaped burners have openings on the bottom and the sides, to introduce combustion air. This combustion air is also used to remove ash from the burner.

Most or all of the known overfed systems have several drawbacks. A major drawback is that the system can only burn clean fuel (fuel with a low ash content), because the combustion air can only remove light ash. If so-called "dirty" fuel, e.g., pellets of non-wood materials such as almond shells, pine bark, peanut shells, or other agricultural products with high silica content, is burned, clinkers (fused masses of non-combustible residues) are produced. The combustion air cannot remove these heavy clinkers. These clinkers build up and grow within the newly combusting fuel mass. The clinkers eventually fill or overlie the burner, whereby newly introduced fuel spills over the burner, and the fire is hindered or even goes out.

Another disadvantage of most overfed systems is that the burner must be cleaned often. This is a time consuming and dirty job, for clinkers must be removed and some residues must be scraped out of the burner.

In an underfed system, fuel is introduced into a burner below the zone of combustion. Typical burners in these systems are cup-shaped and have internal configurations to vertically deflect the fuel which typically is fed into the burner horizontally. Since the fuel moves vertically into the combustion zone, it pushes up most of the clinkers which then fall over the burner edge into an ash box or the like below. The larger clinkers which remain must be removed manually. This system is advantageous for it can burn dirty fuel and some of the clinkers will naturally fall over the burner edge into the ash box below.

A second advantage is efficiency. An underfed system is quite efficient since secondary combustion occurs in addition to primary combustion. Primary combustion occurs below the burner rim as fuel is fed into the combustion zone from below. This combustion is aided by primary combustion air, usually introduced half an inch to an inch below the rim of the burner.

Carbon dioxide is produced in the primary combustion zone. This carbon dioxide combines with glowing hot carbon (charcoal), produced from partially burned pellets, to produce two parts of carbon monoxide, a combustible gas. This carbon monoxide undergoes secondary combustion, which occurs at a point above the zone of primary combustion. Secondary combustion is aided by secondary combustion air, introduced immediately above the burner rim. Since primary and secondary combustion occur simultaneously, the flame temperature is higher, and burning is efficient.

Maintenance is a problem in many underfed systems. It must be done regularly, usually involving manually removing clinkers and scraping of residue formed out of some fuels. This is inconvenient or cumbersome in cup-shaped burners.

OBJECTS OF THE INVENTION

Accordingly, it is an object of the present invention to provide an improved pellet fed heating appliance which can burn a wide variety of fuels.

It is another object of this invention to provide an appliance with a burner which requires very little maintenance and is essentially self cleaning.

Another object of this invention is to provide an appliance which is very fuel efficient.

It is another object to provide a heating appliance which the consumer can easily control.

It is yet another object of the invention to provide an appliance with a burner which avoids clinker build up within the burner and which is easy to clean.

It is yet another object of this invention to provide a burner which underfeeds fuel pellets throughout a combustion zone of an extended length, detains the fuel for a sufficient time so as to ensure combustion but avoids clinker accumulation and affords easy cleaning.

It is an additional object of this invention to provide an appliance with a burner which has an improved secondary air supply system for greater combustion efficiency.

These and yet additional objects and features of this invention will become apparent from the following discussion of the preferred embodiment, and from the attached drawings and appended claims.

SUMMARY OF THE INVENTION

These objects are achieved in a self-contained pellet burning heating appliance having an improved burner assembly which is both efficient and compact for ready inclusion in such appliances. A cross-flow is provided whereby the fuel is introduced from the side of the burner and moves generally sideways through the burner to an open discharge end. By the time the fuel reaches the discharge end it is totally combusted, and the open discharge permits the clinkers and ash to fall to the floor of the combustion chamber or an ashpan. By arranging the system at an incline, an underfed burner action is effected throughout a long combustion zone, while the fuel also continues in more or less constant motion across the burner to the discharge.

More particularly, the burner assembly extends generally horizontally and comprises a retort or combustion receptacle for supporting and confining solid fuel pellets during combustion. The receptacle has an infeed opening at one end, side walls, an open discharge end opposite the infeed and a bottom wall which extends substantially linearly from the infeed to the lower edge of the opposite open discharge end. This receptacle is positioned within a combustion chamber of the heating appliance with at least its discharge end above the floor or other ash receiver. A feed system is provided for forcibly feeding the pellet fuel into this receptacle through the inlet end, toward the open discharge end, in a direction of feed which is generally parallel to the bottom wall. A feed auger which includes an auger encompassed by a tubular housing provides such a feeding action. The feed auger has an inlet at one end of its housing for gravity feed of the pellets from a superjacent hopper into the auger. The auger discharges the pellets axially from its opposite end through the opening in the infeed end of the combustion receptacle at a rate appropriate to the desired rate of combustion. The noncombustible residue is continually discharged from the open end of the combustion receptacle by this feeding action, thereby avoiding accumulation of ash and clinkers in the combustion zone.

The burner assembly is disposed with the floor of the combustion receptacle inclined slightly upward as a feed ramp, preferably at an angle on the order of 22.5 degrees to the horizontal and with the lower edge or "discharge lip" of the open end at an elevation approximately the same as the upper edge of the infeed opening. The angle and dimensions of the combustion receptacle result in the raw pellets being deflected upward into the combustion zone, in the manner of an underfed system, over nearly the entire length of the receptacle. This provides a combustion zone of substantial length and thus large capacity while also providing automatic continual discharge of the noncombustible residue through the open end as a result of the normal infeed of the pellets and attendant motion of the combustion materials across the burner. The inner surfaces of the bottom wall of the auger and the bottom of the receptacle preferably are substantially aligned in colinear relation with one another to facilitate this movement of the materials through the receptacle.

The burner assembly thus provides an underfed feeding action of the pellets into a large combustion zone in the burner receptacle while also effecting the noted continual cross-flow discharge of the noncombusted residue through the open end of that burner receptacle. The side walls of the receptacle are of sufficient height and length to effect this burner action, with adequate residence time for complete combustion. The burner walls also preferably are of a double wall design to serve as a manifold for combustion air, with air supply openings into the receptacle through the inner side walls for supplying primary combustion air in the initial or primary combustion zone, along the entire perimeter of the feed end and sides of the burner receptacle, and with other openings directed inwardly and upwardly through the upper edges to supply air for supporting secondary combustion. Complete combustion is effected with short residence times for high output.

Drive means are provided for operating the feed auger in accordance with control settings, either manually or automatically as from a thermostat, and for supplying combustion air to the manifold. In one example, an electric drive motor is mounted on the infeed end of the auger. A blower driven by another electric motor directs air into a supply conduit formed beneath the feed auger and communicating with the supply manifold space between the spaced walls of the burner receptacle.

The entire burner assembly can be very small and compact and yet provide the desired controlled feeding of pellet fuel for high rates of combustion with continuous discharge of the noncombustible solids from the combustion receptacle.

The various sections of the burner assembly are separated by dividers and surrounded on three sides by a unitary housing member. The dividers are spaced from the bottom of the housing member, thereby providing a passage which permits combustion air to travel to the manifold of the burner section, where it enters the combustion zone through the holes in the walls. A blower fan delivers air into the housing for supply through this passage system to the combustion air openings of the burner.

The system may be controlled by a printed circuit board control panel that regulates the amount of fuel fed to the burner.

DESCRIPTION

For a more complete understanding of the invention reference should be made to the drawings wherein.

Figure 1:
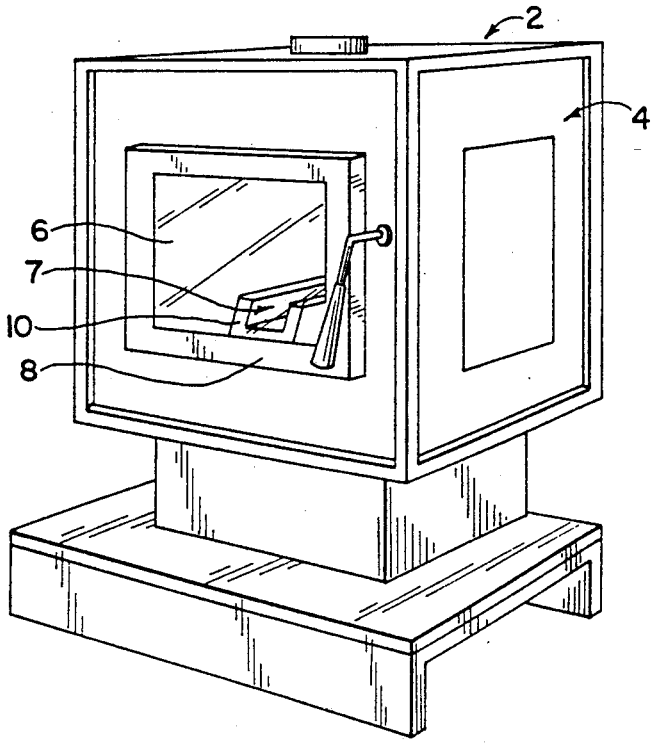
FIG. 1 is a front perspective view of a pellet burning appliance employing teachings of this invention.
Figure 2:
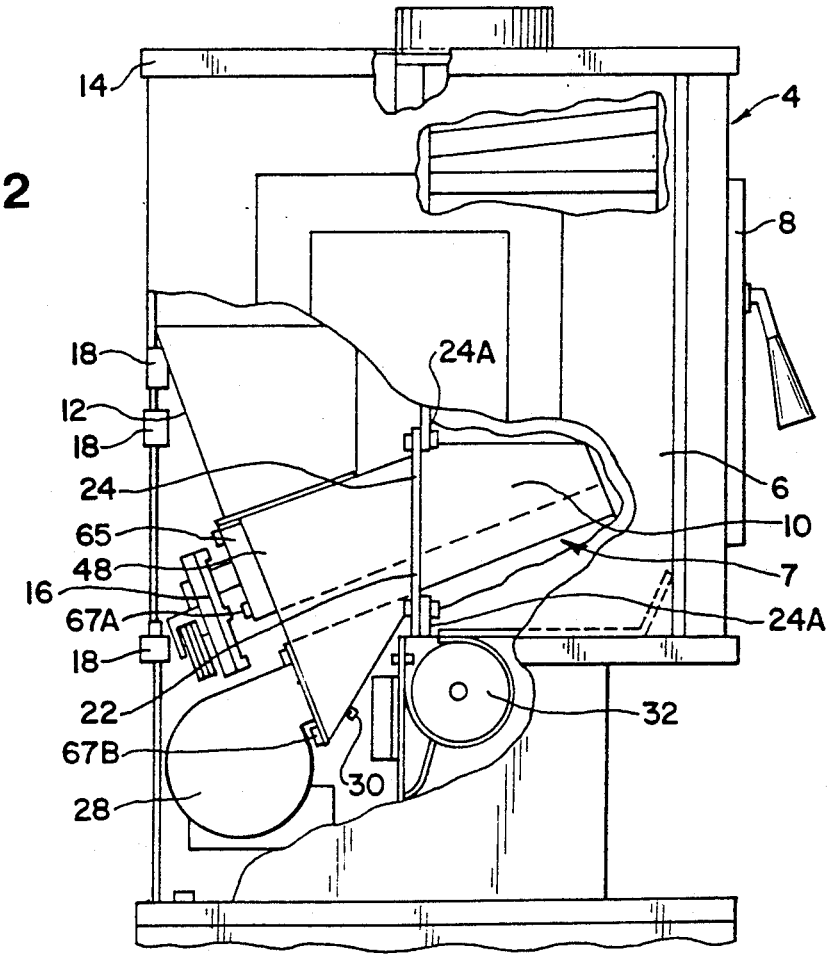
FIG. 2 is a partially cutaway side view of the pellet burning appliance of FIG. 1, illustrating the burner assembly.

Referring to FIGS. 1 and 2, the pellet burning appliance 2 of this invention includes an outer metal cabinet 4 having a combustion chamber 6 and which houses the burner assembly 7. A door 8 provides access to the combustion chamber, such as for removal of ash and other combustion residue and for cleaning of the burner 10. Ceramic logs or other decorative items, made of refractory materials, can be placed in combustion chamber 6 to provide an enhanced aesthetic appearance of the fire.

Figure 3:
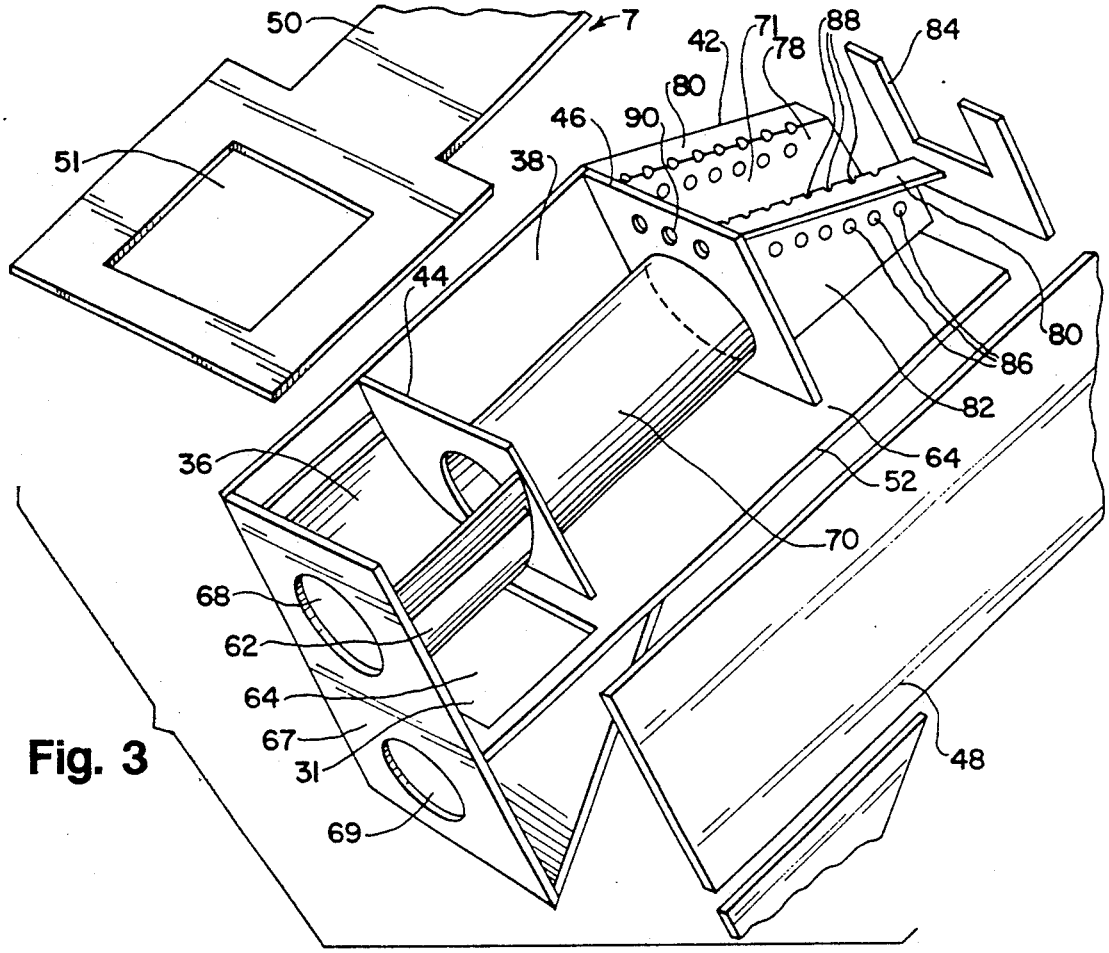
FIG. 3 is an exploded view of the burner assembly, without the auger.
Figure 4:
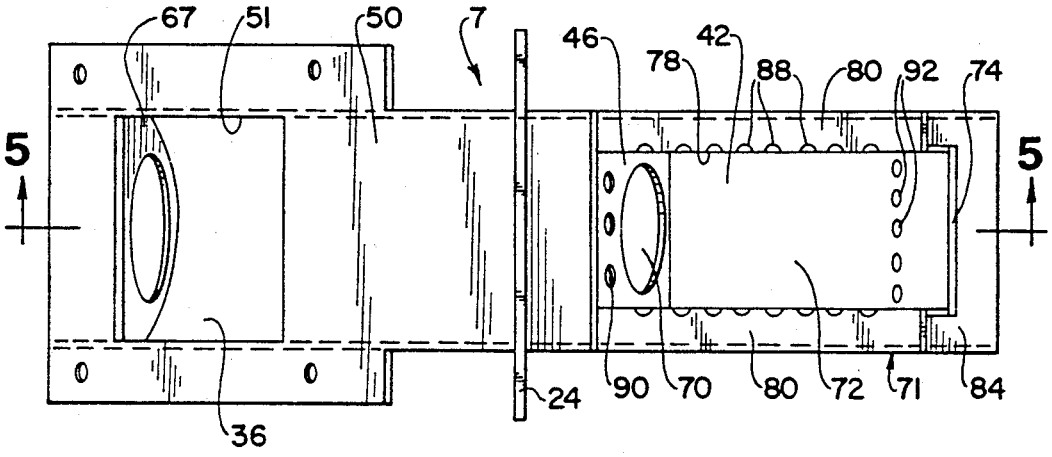
FIG. 4 is a top view of the burner assembly.
Figure 5:
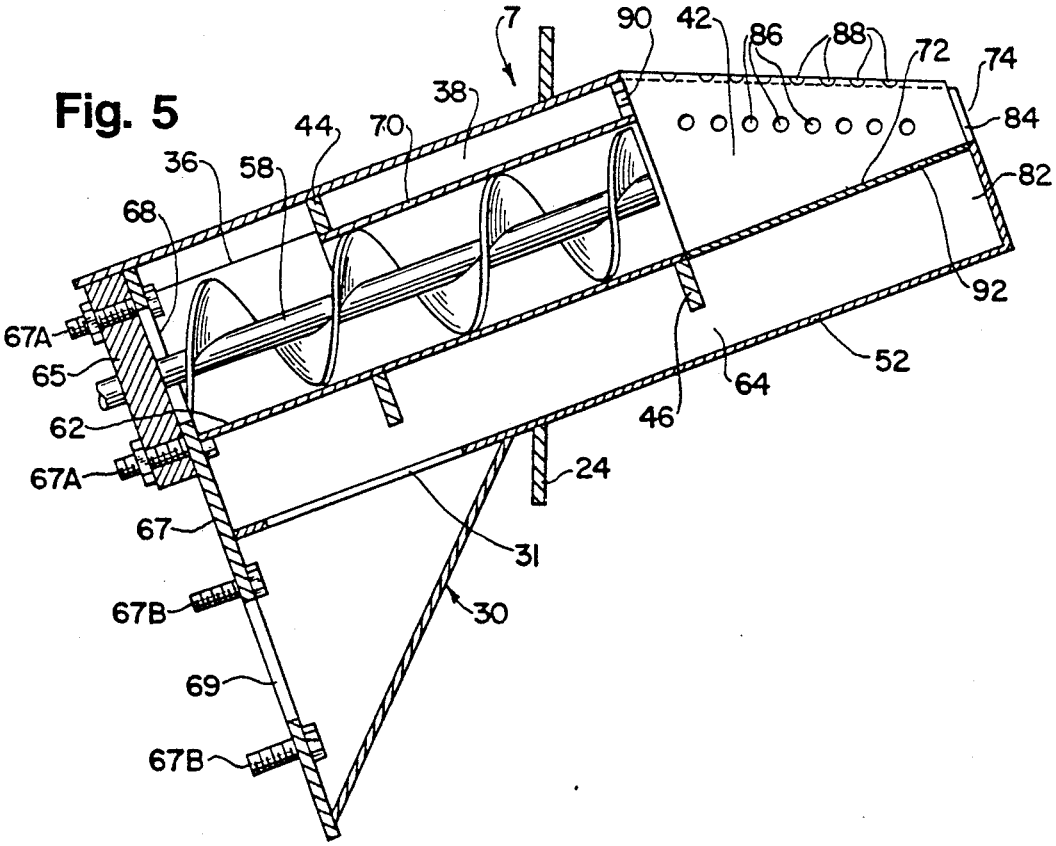
FIG. 5 is a center vertical sectional view of the burner assembly.

Turning to FIG. 2, the burner assembly 7 is shown assembled within the pellet burning appliance 2. Referring preliminarily to FIGS. 3, 4, and 5, the burner assembly 7 comprises generally the burner 10, a feed auger 58 with an intake hopper section 36, a support housing 48 and a combustion air delivery system which includes a blower 28. The burner 10 is disposed within the combustion chamber 6. Pellets are loaded in bulk into a hopper 12 which is closed by a top cover 14. The storage hopper occupies substantially all of the upper rear cavity of the appliance, preferably extending to the top of the appliance. In a preferred embodiment, the hopper capacity is on the order of 60 pounds. With this large capacity, the user does not have to fill the hopper frequently. This hopper 12 is sealed by the cover 14, and the remainder of the pellet feed system is closed except for the discharge end of the auger, so as to prevent air inflow to the feeder system and thereby prevent pellet combustion in the auger feed tube or hopper (known as back burning).

Pellets from the hopper 12 are gravity fed into the hopper intake 3 of the burner assembly wherein they contact the feed auger 58. The auger is controlled by an electric drive motor assembly 16. However, the auger can also be driven mechanically, pneumatically, or by any other equivalent means. Electric switches 18 control the auger's power supply. The auger carries the pellets to the retort end of the burner assembly for combustion in the burner receptacle 10.

The burner assembly 7 includes a mounting flange 24 welded to the outer housing 48 and protrudes into the chamber 6 through a rear wall plate 24A which mounts and secures the assembly 7 in this position. The burner assembly is angled upward from the intake 36 through the burner 10 at an angle of about 22.5 degrees to the horizontal. This angled position is advantageous for it allows fuel to enter the retort or burner 10 from under the combustion zone, enabling both primary and secondary combustion, in the manner of an underfed system. A burn having primary and secondary combustion yields a hotter flame and consequently greater efficiency. While an inclination angle of about 22.5 degrees presently is preferred, angles ranging from 15° to 30° are also appropriate, depending upon related factors, as discussed further hereinafter.

The blower 28 supplies primary and secondary combustion air. The blower communicates with the burner assembly 7 via a depending manifold housing 30, attached over an opening 31 (FIG. 5) through the floor of the burner housing. The blower 28 is controlled by suitable manual or automatic controls, such as through switches 18; see also FIG. 6. A plug connects the electrical system of the appliance to an external power source.

FIGS. 3, 4, and 5 show the burner assembly 7 in greater detail. The assembly comprises three sections, a first holding section comprising the intake hopper 36, a second or feed conveyor section 38 and a third or burner section 42. These sections are separated by dividers 44,46 and the entire burner assembly is surrounded by a housing 48. A top plate 50 covers the first and second sections and forms a closed connection with the hopper 12. The plate 50 has an opening 51 over the first section accommodating the flow of pellets from the lower end of the hopper. The dividing plates 44,46 are flush with and affixed as by welding to the housing's sidewalls and flush with the top plate 50 but do not extend to the floor 52 of the housing 48, creating gaps therebeneath whereby a continuous passage is provided for flow of primary and secondary combustion air from the manifold housing 30 to the burner 10.

Pellets from the hopper fall freely into the first section's upper intake hopper chamber 36 where they are engaged by the auger 58. A dividing floor 62 preferably curved to accommodate the auger 58 separates the upper chamber 36 from the lower air passage chamber 64. The lower chamber 64 is an air space which communicates with the blower 28 through the opening 31 in the housing floor 52. An end closure and bearing plate 67 with an opening 68 to accommodate a bearing 65 for auger 58 and an opening 69 to mate with the blower 28 closes the terminal end of this first section 36. Mounting means, such as the illustrated bolts 67A and 67B are provided to mount the bearing 65 and blower 28 on the housing 48.

When assembled, the auger extends from its bearing 65 at end plate 67 to a discharge end approximately in the plane of plate 46. Once in contact with the auger 58, the pellets are transported thereby through the tubular auger housing 70 in second section 38. In the preferred embodiment, the auger tube 70 is spaced from the walls of housing 48, which allows combustion air to flow freely from the blower to the combustion air supply openings to burner 10. The auger conveyor discharges the pellets into the burner 10 through the inlet end defined by plate 46.

The burner is a retort, open at its terminal end 74. The burner 10 includes an inner wall 71 which defines the combustion receptacle. It is generally U-shaped in cross-section, of uniform width and tapered in height over its length. The height at the inlet end is somewhat greater than the diameter of the discharge opening corresponding to the feeder tube 70. The taper angle preferably corresponds to the angle of inclination of the burner assembly such that the upper edges of the burner sides are substantially horizontal, as will be seen from FIGS. 2 and 5. The inner wall 71 includes an inner floor 72 which is inclined to the horizontal colinear with the lowermost tangent segment of the auger tube 70 from the inlet end to the discharge edge at the remote end 74. A floor which is smooth and substantially linear, i.e., has no abrupt changes in contour from the inlet end to the discharge at 74, inhibits clinker buildup as the continual introduction of fuel pellets moves the bed in burner 10 toward the discharge end and pushes clinkers and other combusted fuel residues off the retort end 74 to fall to the floor of the combustion chamber 6 or into an ash box (not shown).

The sides 78 of the retort wall extend upwardly from the floor 72 and outwardly to form flanges 80 which are joined as by welding to the burner housing 48. The spaced walls of the member 71 and the housing 48 along the bottom and sides of the retort from a manifold 82 around the wall 71. Combustion air enters this manifold 82 from the passage 64, under the dividing plate 46. An end plate 84 closes the space between the outer housing 48 and the retort's floor, sides and flanges to close the outer end of the manifold space.

Combustion air from the blower 28 is introduced to the retort from the passage 64 through various series of air holes 86, 88, 90 and 92. Primary combustion air enters through air holes 86 in the sides 78, beneath the upper edges, and through holes 92 through the floor 72 near the discharge end 74. Secondary combustion air enters through air holes 88 at the upper edges of the sides 78, at the bend between the respective side and flange 80 and holes 90 in the divider plate 46 above the feed inlet. Preferably, the secondary air holes are angled inward and upward, e.g., at an angle of 45°. Simultaneous provision of primary and secondary combustion air yields a hot flame and highly efficient burning and a low particulate emission. Secondary combustion is aided by secondary combustion air supplied through the secondary combustion air holes 88 and 90.

In operation of the burner or retort, after combustion is established, the pellets fill or substantially fill the retort receptacle 71. The combustion zone, established and aided by the air through the ports 86, extends downward into the bed of pellets a significant distance beneath the upper edges of the receptacle. Due to the depth of the receptacle at the inlet end, the feed auger continues to add raw pellets along the floor 72, beneath the primary combustion zone. Due to the ramp nature of the floor 72, this advancing motion causes the pellets to be fed with a rising motion in the nature of an underfed system along most of the length of the receptacle, with combustion continuing over the full width and most of the length of the receptacle. This provides a relatively large combustion zone which permits burning of substantial quantities of the pellets for concomitant high heating output with a small burner assembly. Moreover, this feeding movement pattern results in cross-movement of the residue and discharge thereof through the open end of the combustion receptacle 71 at 74 from which it drops into the lower portion of the combustion chamber.

The preferred embodiment of the burner assembly is relatively small, designed to fit within a 30 inch deep appliance, suitable for home use. However, the attendant small size requirements are met while providing efficient burning of large amounts of material to provide high heat outputs. In one example of an appliance 2, the burner assembly 7 is 13.5" long, with an outer housing 4" wide and 4.88" high. The burner receptacle 71 has inside dimensions of about 2.5" wide, 3.12" high at the inlet end, 5" long and a 22.5 degree taper to a depth at the discharge end 74 of about 1". Primary and secondary combustion air is supplied through the passage and hole system as illustrated, using a blower of approximately 50 CFM capacity. The feed auger 58 is about 2.25" O.D. This unit can burn up to 5 lbs. of pellets per hour, providing up to about 38,000 BTU/hour.

As indicated above, the angle of inclination of the burner floor may be varied. The parameters include the depth of the fuel bed at the inlet end, the length and thus the extent and capacity desired for the combustion zone, the configuration of the floor, and retention of the capability of the infeed action to continually move the materials across the combustion receptacle during combustion for discharge of the residue through the open opposite end. The depth of the bed at the inlet end should at least cover the infeed opening in order to obtain the underfeeding action described above. Also, the discharge lip at the opposite end should be no higher than approximating the level of the upper edge of the infeed in order to maintain the described long combustion zone and cross-flow feeding and discharge action. In general, if greater angles of incline are utilized, the burner receptacle and thus the combustion zone accordingly will be shorter, with likely reduction of the combustion capacity. Lower angles of inclination may require longer burner receptacles to provide adequate cross-flow resistance to obtain the underfeeding action of the raw pellets, and be further limited by the need for movement through the entire combustion bed to the open discharge end. Also, the receptacle floor need not be planar, but may change slightly or be gently curvilinear, without abrupt changes. lips or steep inclines which will thwart the noted cross-flow movement of the materials. Further, while the colinear arrangement of the infeed and the floor of the burner receptacle are preferred, there may be some deviation between these two components, e.g., with an infeed auger which is horizontal or at a lesser angle of inclination than the burner floor.

Figure 6:
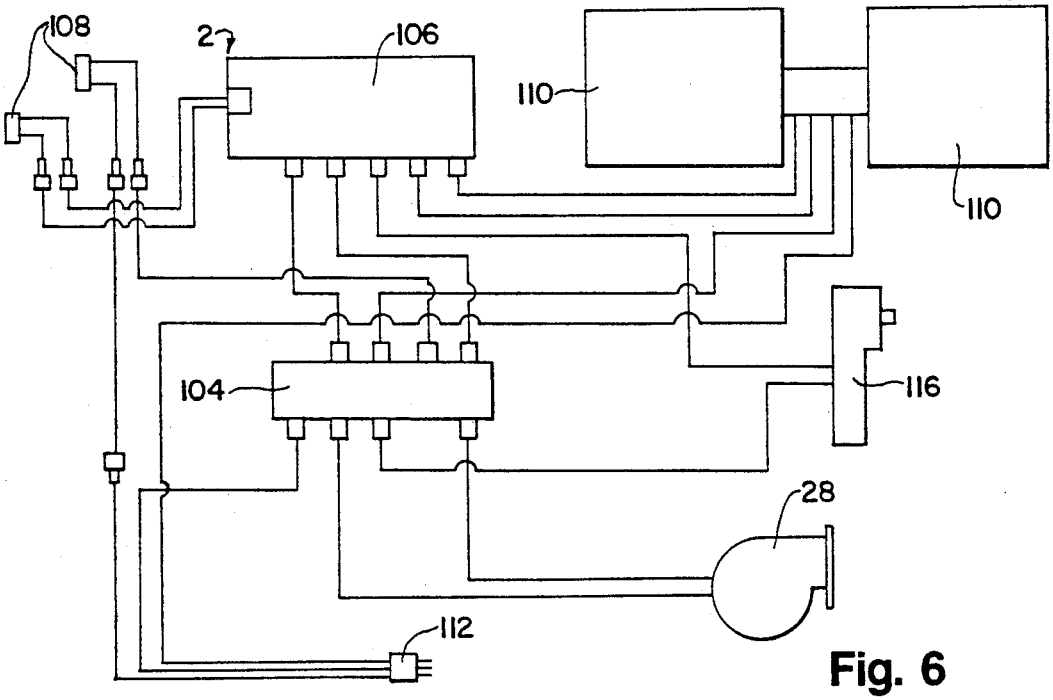
FIG. 6 is a circuit diagram of one set of controls for the appliance of FIG. 1.

FIG. 6 shows an example of control circuitry associated with the appliance 2. This circuitry consists of a terminal block 104, and a control panel 106 which the user activates through switches 108 or a thermostat to regulate the temperature by changing the pellet feed rate. This control panel also controls power to the convection blower assembly !10, the motor of the combustion air blower 28 and the auger motor assembly 116. A power cord 112 connects to a suitable external power source.

Having described herein various embodiments of the present invention, it is not intended that the invention be limited to the specific forms described above. For example, parameters may be varied within the scope of the present invention. Thus, the present invention shall not be limited or restricted to specific details set forth herein, and the invention shall be considered as falling within the scope of the following claims.

What is claimed is:

1. A heater assembly for burning a variety of combustible solid fuel materials, comprising:
   - a chamber suitable for combustion of such fuels therein and having a floor portion for receiving noncombustible residue;
   - a burner assembly extending into said chamber, said burner assembly comprising:
     - a. a conveyor conduit having at least one end located outside of said chamber;
     - b. means for receiving said combustible solid materials at said one end of said conduit;
     - c. means located in said combustion chamber for supporting and confining said combustible materials during burning so as to provide a combustion zone for said materials, said supporting and confining means having an inlet end communicating with the opposite end of said conduit, said supporting and confining means having an open terminal end which is located opposite said inlet end and has a discharge edge located above said floor portion of said chamber, and an upwardly inclined bottom surface for supporting said materials, said inclined bottom surface extending substantially linearly from said inlet end to said discharge edge; and
     - d. means for forcibly moving said combustible material from said receiving means through said conveyor conduit and into said supporting and confining means, whereby said combustible material burns within said combustion zone and the noncombustible residue is discharged from said open terminal end of said supporting and confining means to said floor portion of said chamber.

2. The invention as in claim 1 wherein said inlet end of said supporting and confining means has an opening therein for receiving said fuel materials from said means for forcibly moving said materials thereinto, and said discharge edge is at an elevation substantially equal to the elevation of the top of said opening.

3. The invention as in claim 1 or 2 wherein said means for forcibly moving said materials into said supporting and confining means is a feed auger having a longitudinal feed axis substantially parallel to said bottom surface of said supporting and confining means.

4. The invention as in claim 3 wherein said feed auger is disposed with its lowermost edge substantially coplanar with said bottom surface.

5. A heater assembly for burning a variety of combustible solid fuel materials, comprising:
   - a chamber suitable for combustion of such fuels therein and having a floor portion for receiving noncombustible residue;
   - a burner assembly extending into said chamber, said burner assembly comprising:
     - a. a conveyor conduit having at least one end located outside of said chamber;
     - b. means for receiving said combustible solid materials at said one end of said conduit;
     - c. means located in said combustion chamber for supporting and confining said combustible materials during burning so as to provide a combustion zone for said materials, said supporting and confining means having an inlet end communicating with the opposite end of said conduit, said supporting and confining means having an open terminal end which is located opposite said inlet end and has a discharge edge located above said floor portion of said chamber, and a bottom surface for supporting said materials and extending substantially linearly from said inlet end to said discharge edge; and d. means for forcibly moving said combustible material from said receiving means through said conveyor conduit and into said supporting and confining means, whereby said combustible material burns within said combustion zone and the noncombustible residue is discharge from said open terminal end of said supporting and confining means to said floor portion of said chamber;

wherein said burner assembly is inclined upwardly within said heater assembly at approximately 22.5 degrees from the horizontal, from said receiving means to said discharge edge.

6. The invention of claim 5, wherein said burner assembly additionally includes an outer housing, said outer housing surrounding and supporting said receiving means, said conveyor conduit and said supporting and confining means, said housing having side walls and a floor which extend below said receiving means, said conveyor conduit and said supporting and confining means and providing an air passageway extending adjacent said supporting and confining means.

7. The invention of claim 6, including a blower in communication with said air passageway.

8. The invention of claim 6, wherein said supporting and confining means comprises a retort, said retort including a floor, substantially colinear with the lowermost portion of said conveyor conduit, said sidewalls Which are tapered downwardly from said inlet end toward said open terminal end, and flanges extending from said sidewalls to said outer housing.

9. The invention of claim 8, wherein said floor of said retort contains apertures for introducing primary combustion air.

10. The invention of claim 8, including apertures through said sidewalls for introducing combustion air into said retort.

11. A burner assembly comprising:

a combustion receptacle for supporting and confining combustible material during combustion thereof, said receptacle having an inlet end, side walls, an open discharge end opposite said inlet end and having a bottom edge, and a bottom wall extending substantially linearly from adjacent said inlet end to adjacent said bottom edge of said open discharge end, said side walls being tapered in height from a first height adjacent said inlet end to a second height adjacent said discharge end of said combustion receptacle and said second height being substantially less than said first height; and feed means for pushing solid fuel into said receptacle from said inlet end toward said outlet discharge end, whereby non-combustible residue from the combustion of such material in said receptacle will be continually discharged through said open end during operation of said burner.

12. The invention as in claim 11 wherein said feed means pushes said fuel into said receptacle at a first level, and said receptacle includes air supply means for supplying primary combustion air into said receptacle above said first level.

13. The invention as in claim 12 wherein said receptacle includes air supply means for supplying secondary combustion air into said receptacle above said means for supplying primary combustion air.

14. The invention as in claim 12 or 13 wherein said receptacle includes spaced inner and outer walls and said air supply means include holes through said inner wall and means for supplying such air to the space between said inner and outer walls.

15. The invention as in claim 11 for burning solid fuel in pellet form, wherein said feed means comprises a feed auger having a discharge end in communication with said receptacle at said inlet end thereof, said feed auger also having an inlet adjacent its opposite end for receiving such pellet form fuel for conveyance thereby into said receptacle through said inlet end.

16. The invention as in claim 15 wherein said feed auger includes an elongated auger housing having a lowermost segment, and said bottom wall of said combustion receptacle is substantially colinear with said segment.

17. The invention as in claim 16 wherein said bottom wall is planar and has its upper surface aligned with the upper surface of said segment.

18. The invention as in claim 15 wherein said side walls are of a height adjacent said inlet end to extend above said discharge end of said auger.

19. The invention as in claim 11 or 18 wherein said side walls are provided with combustion air inlet openings along the upper portions thereof and said burner assembly includes means for supplying combustion air through said air inlet openings.

20. A burner assembly comprising:

a combustion receptacle for supporting and confining combustible material during combustion thereof, said receptacle having an inlet end, side walls, an open discharge end opposite said inlet end and having a bottom edge, and a bottom wall extending substantially linearly from adjacent said inlet end to adjacent said bottom edge of said open discharge end;

feed means for pushing solid fuel into said receptacle from said inlet end toward said outlet discharge end, whereby non-combustible residue from the combustion of such material in said receptacle will be continually discharged through said open end during operation of said burner; and means for mounting said burner assembly with said bottom wall of said combustion receptacle inclined upwardly from said inlet end to said discharge end thereof.

21. The invention as in claim 20 wherein said feed means pushes said fuel into said receptacle at a first level, and said receptacle includes air supply means for supplying primary combustion air into said receptacle above said first level.

22. The invention as in claim 21 wherein said receptacle includes air supply means for supplying secondary combustion air into said receptacle above said means for supplying primary combustion air.

23. The invention as in claim 21 or 22 wherein said receptacle includes spaced inner and outer walls and said air supply means includes holes through said inner wall and means for supplying such air to the space between said inner and outer walls.

24. The invention as in claim 20 for burning solid fuel in pellet form, wherein said feed means comprises a feed auger having a discharge end in communication with said receptacle at said inlet end thereof, said feed auger also having an inlet adjacent its opposite end for receiving such pellet form fuel for conveyance thereby into said receptacle through said inlet end.

25. The invention as in claim 24 wherein said feed auger includes an elongated auger housing having a lowermost segment, and said bottom wall of said combustion receptacle is substantially colinear with said segment.

26. The invention as in claim 25 wherein said bottom wall is planar and has its upper surface aligned with the upper surface of said segment.

27. The invention as in claim 24 wherein said mounting means supports said burner assembly with said discharge end of said combustion receptacle at an elevation substantially equal to the elevation of the top of said discharge end of said auger.

28. The invention as in claim 24 wherein said side walls are of a height adjacent said inlet end to extend above said discharge end of said auger and taper to lower heights outwardly thereof such that their upper edges are substantially horizontal when said burner assembly is so supported by said mounting means.

29. The invention as in claim 28 wherein said are provided with combustion air inlet openings along the upper portions thereof and said burner assembly includes means for supplying combustion air through said air inlet openings.

30. The invention as in claims 11, 12, 13, 15, 20, 21, 22, 24 or 29 and wherein said burner assembly includes an outer supporting housing, said housing defining air passage and manifold means for supplying combustion air to said combustion receptacle.

31. The invention as in claim 11, 12, 13 or 15 and wherein said burner assembly includes an outer support housing, said housing defining air passage and manifold means for supplying combustion air adjacent said inlet end and said side walls, and said inlet end and said side walls having openings therethrough for admitting said combustion air into said combustion receptacle.

* * * * *